United States Patent [19]

Gitt

[11] 4,103,382

[45] Aug. 1, 1978

[54] ADHESIVE DEVICE FOR CLEANING HARD TO REACH AREAS

[76] Inventor: Jeffrey J. Gitt, 13368 LaBarge Dr., St. Louis County, Mo. 63141

[21] Appl. No.: 740,178

[22] Filed: Nov. 8, 1976

[51] Int. Cl.[2] ..... A47L 13/00

[52] U.S. Cl. ..... 15/104 R; 15/105; 15/145; 15/104 A

[58] Field of Search ..... 15/104 R, 104 A, 105, 15/209 D, 246; 43/114, 115, 134, 136; 242/118.32, 130.1

[56] References Cited

U.S. PATENT DOCUMENTS

| | | | |
|---|---|---|---|
| D. 34,278 | 3/1901 | Lloyd | D22/19 |
| 398,002 | 2/1889 | Scott | 242/118.32 |
| 1,194,736 | 8/1916 | Holden | 43/114 |
| 1,388,951 | 8/1921 | Hubbard | 242/118.32 |
| 1,480,539 | 1/1924 | Grecu | 43/136 UX |
| 1,533,913 | 4/1925 | Heymann | 242/118.32 X |
| 1,655,309 | 1/1928 | Bose | 15/246 |
| 1,974,002 | 9/1934 | Anderson | 242/130.1 X |
| 2,378,901 | 6/1945 | Armhein | 242/118.32 |
| 3,225,373 | 12/1965 | Kisbany | 15/104 A |
| 3,503,089 | 3/1970 | Coneway | 15/160 |

FOREIGN PATENT DOCUMENTS

| | | | |
|---|---|---|---|
| 634,514 | 11/1927 | France | 242/130.1 |

*Primary Examiner*—Daniel Blum

*Attorney, Agent, or Firm*—Richard J. Sher

[57] ABSTRACT

Disposable cleaning devices, preferably constructed entirely of paper, having a conically shaped head with a jagged or tacky exterior surface for clinging to and removing cob webs and the like from hard to clean areas such as corners. A hollow stem portion connected to the conical head is sized to fit onto and frictionally engage the ends of standard broom handles and the like to provide simple inexpensive means for cleaning ceilings and other normally out of reach locations.

2 Claims, 7 Drawing Figures

ADHESIVE DEVICE FOR CLEANING HARD TO REACH AREAS

BACKGROUND AND SUMMARY OF THE INVENTION

The invention relates to the art of cleaning and is particularly useful in removing dust accumulations, cob webs, spider webs and the like from hard to clean or out-of-reach areas such as corners and ceilings.

In the prior art it is common for the housewife or maintenance man to rid corners and ceilings of cob webs and spider webs with a conventional dust mop having a long handle and a cloth head supported on a metal webbing. The conventional dust mop is difficult to use in cleaning corners and ceilings since it is not shaped for easy insertion into corners and is bulkly and unweildy when utilized overhead. Further, the dust mop may not effectively hold cob webs freed from the ceiling causing the material to fall onto the floor or the person holding the mop. Also, since the dust mop head is a relatively expensive item, the housewife is required to remove the accumulated dust and webs from the mop head, and this chore can be extremely distasteful.

The present invention provides for cleaning devices which are light for ease of maneuverability and extremely inexpensive for disposability; conically shaped for facile insertion into corners; provided with a tacky exterior surface to effectively clean and hold cob webs and the like thereon; and, include stem means which may be readily mounted on and removed from any elongated rod found around the house, such as common broomsticks of various diameters, and which may be hand-held in such a manner that the operator may clean and dispose of webs, etc., without ever coming into personal contact with same.

It is therefore a primary object of the invention to provide inexpensive, disposable cleaning devices for the removal of spider webs, cob webs and other dust accumulations from corners, ceilings and other inaccessible locations.

It is a further object to provide cleaning devices which are extremely light for easy maneuverability.

It is a still further object to provide cleaning devices which are conically shaped and include a tacky exterior surface for the effective removal of debris such as cob webs from corners and other areas of limited access and the retention of such debris thereon.

It is a still further object of the invention to provide cleaning devices of the character stated hereinabove which include simple means for hand holding or mounting the device on common broomsticks and the like.

These, as well as other objects, and advantages of the instant invention will become more readily apparent from a reading of the following description of the preferred embodiments in conjunction with the drawings wherein.

DESCRIPTION OF THE EMBODIMENTS

Figure 1:
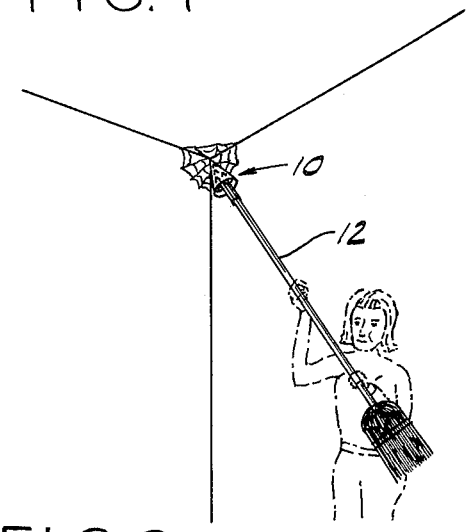
FIG. 1 is a perspective view of a cleaning device as it might be used on a conventional broomstick to remove cob webs and the like from a ceiling corner.

FIG. 1 shows a cleaning device generally indicated by numeral 10, being utilized to remove a cob web from a ceiling corner. Device 10 may be placed on the end of a common broomstick 12 in order to extend the reach of the housewife or maintenance man utilizing the cleaning device.

Figure 2:
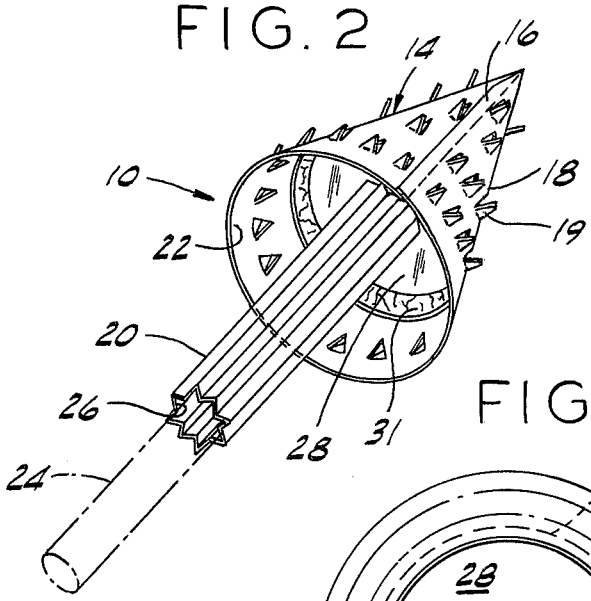
FIG. 2 is an enlarged perspective view of the cleaning device with the broomstick shown in broken line.
Figure 3:
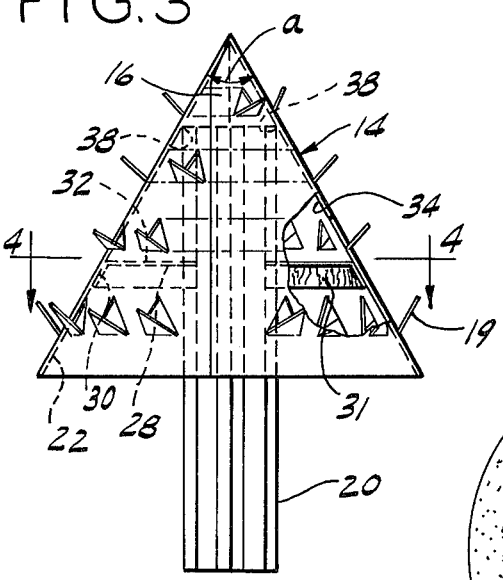
FIG. 3 is a side elevational view, partially broken away, of the cleaning device of FIG. 2.
Figure 4:
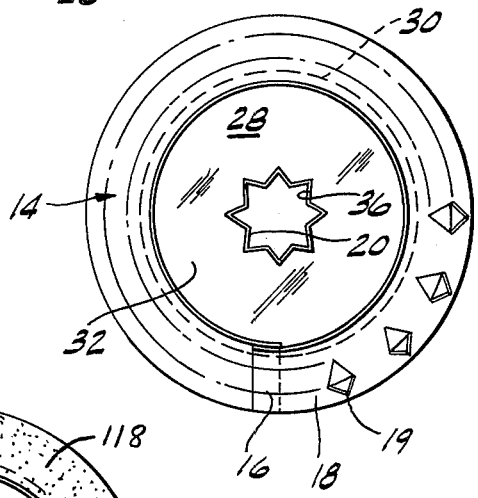
FIG. 4 is a horizontal cross section taken along line 4—4 of FIG. 3.

With reference to FIGS. 2–4, one embodiment of the cleaning device 10 is illustrated.

Device 10 is preferably fabricated entirely of paper which is of sufficient strength and thickness to preserve the structural integrity thereof throughout the desired cleaning operation. Cleaning device 10 includes a conical head member 14 formed from a single paper blank which is turned upon itself and glued or stapled along overlapping seam 16. The outer surface 18 of head member 14 is perforated outwardly to produce a jagged surface having projections or barbs 19 which provide means for collecting and clinging to cob webs and the like during the cleaning operation. The apex angle *a* of head member 14 is less than 90 degrees to allow for facile insertion into corners, and angle *a* is preferably between 40° and 70°. Head member 14 is connected to elongated, hollow handle or stem member 20 which is positioned coaxially therewith and which extends outwardly through opening 22 of conical head member 14 a sufficient distance, for example six inches, to provide a handle for manual holding thereof and to provide stability if mounted on a rod such as a broomstick 24. Stem member 20 is formed from a single rectangular paper blank which is corrugated in transverse cross section thereby producing longitudinally extending peak and valley lines and which is secured to itself to form an elongated, expandable, axially-extending passageway 26 therethrough. The diameter of passageway 26 is sized to initially be slightly smaller than that of a conventional broomstick 24, yet passageway 26 will expand upon insertion of the broomstick 24 to provide a secure, stable friction fit.

Stem member 20 is held within opening 22 of head member 14 by a connecting disk 28 fabricated from a single circular paper blank. Disk 28 is provided with a peripheral skirt portion 30 which is formed by crimping, as shown at 31, and which depends from the flat body 32 of disk 28 at an angle to conform with the interior surface 34 of head member 14, thus faciliating the connection therebetween as by gluing.

Centrally located in disk 28 is provided a hole 36 having a shape substantially corresponding to the cross section of stem member 20 and being sized slightly smaller than the unexpanded size of stem member 20 to thereby maintain a friction fit of stem member 20 within hole 36. It is noted, however, that glue may also be applied to the edge of hole 36 to more securely join stem member 20 to disk 28. As shown in FIG. 3 stem member 20 extends through hole 36 and abuts against the interior of head member 14 as at 38 thus providing greater stability to the structure.

Figure 6:
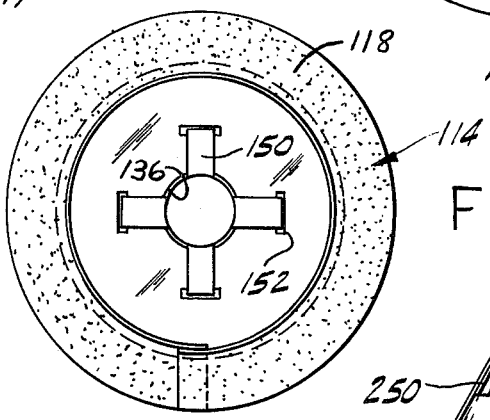
FIG. 6 is a horizontal cross section of the device taken along line 6—6 of FIG. 5; and, FIG. 7 is a vertical cross section of another embodiment of the cleaning device.
Figure 5:
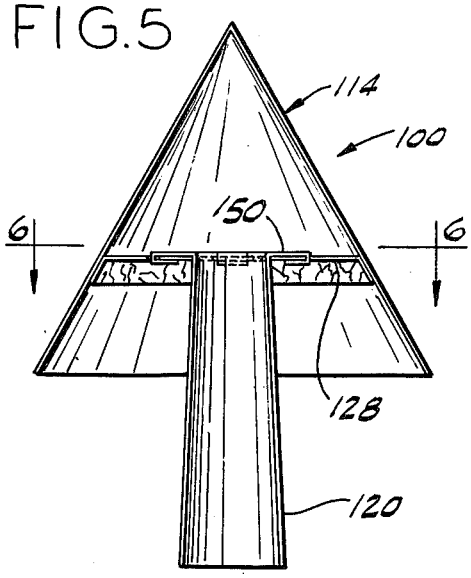
FIG. 5 is a vertical cross section of the preferred embodiment of a cleaning device according to the principles of the invention.

FIGS. 5 and 6 illustrate the preferred embodiment 100 of the cleaning device. Embodiment 100 includes head member 114 connected to stem member 120 by means of disk 128. Disk 128 is connected to the interior of head member 114 in the same manner set forth with respect to the structure of FIGS. 2–4. Stem member 120 is not corrugated as in the prior-mentioned embodiment but instead is tapered toward head member 114 to accommodate different sizes of broomsticks and the like. As the broomstick is inserted into tapered stem member 120 it will reach a point wherein the diameter of stem member 120 becomes slightly less than that of the broomstick, thus providing a frictional engagement therebetween. Stem member 120 passes through centrally-located, circular hole 136 in disk 128 and includes integral tabs 150 on the top of stem member 120 which are folded down onto disk 128. The ends of tabs 150 are inserted downwardly through respective slots 152 and then folded upwardly along disk 128 to provide a secure connection between stem member 120 and disk 128. If desired, slots 152 may be eliminated and tabs 150 glued directly onto the upper surface of disk 128.

Head member 114 is not perforated as is head member 14 of embodiment 10. Instead, head member 114 is provided on the outer surface thereof 118 with a tacky substance, such as that used on common masking tape, which will adhere to dust, webs and the like during the cleaning process, yet will not strongly adhere to walls and like objects, thus allowing to and fro movement of the device against walls without disturbing the integrity of the paper structure.

Figure 7:
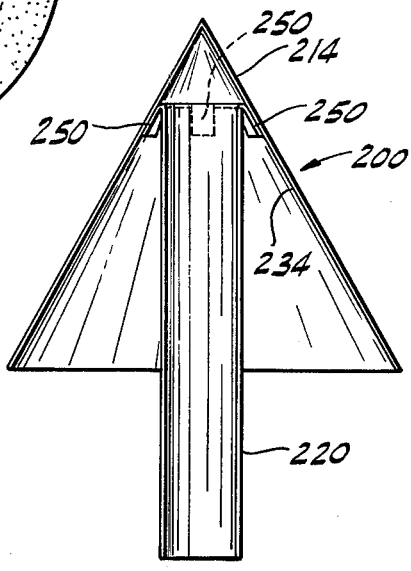

FIG. 7 shows another embodiment 200 of the cleaning device wherein a cylindrical stem member 220 having an internal diameter equal to the diameter of a standard broomstick and having a plurality of outwardly and downwardly directed tabs 250 at the upper end thereof is attached to the interior surface 234 of head member 214 by gluing tabs 250 directly to inner surface 234. While the embodiment of FIG. 7 is slightly less stable than those of FIGS. 2–6, it is also slightly more economical to manufacture.

In use, the cleaning device of the present invention may be hand-held by stem 120, when no handle extension is required such as when cleaning around base boards and floor corners. When it is desired to clean hard-to-reach areas, any rod such as common broomstick 24 may be inserted into stem 20 to frictionally engage same thus producing a light maneuverable cleaning device. Dust, webs and the like may be easily removed from ceiling corners by extending conical head member 114 into the corner and moving it to and fro between the walls while simultaneously revolving the head about its axis. Inasmuch as the outer surface 118 of head member 114 is tacky, the dust and webs will cling to head member 114 thus effecting efficient removal and detention of the debris and alleviating the possibility of the web falling on the operator. Further, after the cleaning is accomplished the device may be removed from the rod or broomstick 24 by sliding stem 120 therefrom and the entire soiled assembly may be disposed of without the operator coming into contact with the debris.

It can therefore be appreciated that the instant invention provides for a cleaning device which is easy to use, effective, and extremely inexpensive to manufacture rendering it disposable.

Inasmuch as numerous modifications may be made to the construction of the present invention without departing from the spirit and scope thereof, it is requested that the scope of the invention be determined solely by the claims appended hereto.

I claim:

1. A disposable cleaning device for connection to a conventional broom handle comprising:

a hollow conical member having a solid exterior surface contiguous with the apex thereof and formed from a single paper blank;

said conical member including a tacky substance means on the exterior surface thereof for holding debris thereon;

a paper, circular disk having a peripheral, crimped, depending skirt adhesively connected to the interior surface of said conical member and positioned coaxially therewith;

said disk having a central passageway therethrough;

a paper tubular stem member passing through said passageway;

said stem member including a plurality of integral tab members at the inner end thereof, and said tab members being bent radially outwardly with respect to said stem member and being secured to said disk;

said conical member having an apex angle of less than 90°;

said tubular stem member being tapered toward said conical member and having decreasing inside diameters from the outer end to said inner end thereof, and the range of said inside diameters being such that conventional broom handles will frictionally engage the interior of said stem member at some degree of axial insertion of such broom handle within said stem member.

2. A cleaning device as specified in claim 1, wherein:

said disk includes a plurality of slots spaced around said passageway; and said tabs being inserted through respective ones of said slots.

* * * * *